US011078703B2

(12) United States Patent
Ritzi

(10) Patent No.: US 11,078,703 B2
(45) Date of Patent: Aug. 3, 2021

(54) SLIDING WALL ARRANGEMENT WITH A COVERING ELEMENT

(71) Applicant: SOREG AG, Wädenswil (CH)

(72) Inventor: Marcel Ritzi, Wädenswil (CH)

(73) Assignee: SOREG AG, Wädenswil (CH)

( * ) Notice: Subject to any disclaimer, the term of this patent is extended or adjusted under 35 U.S.C. 154(b) by 216 days.

(21) Appl. No.: 16/312,502

(22) PCT Filed: Jun. 23, 2017

(86) PCT No.: PCT/EP2017/065512
§ 371 (c)(1),
(2) Date: Dec. 21, 2018

(87) PCT Pub. No.: WO2017/220770
PCT Pub. Date: Dec. 28, 2017

(65) Prior Publication Data

US 2019/0162003 A1 May 30, 2019

(30) Foreign Application Priority Data

Jun. 24, 2016 (EP) ..... 16176213

(51) Int. Cl.
*E05D 15/06* (2006.01)

(52) U.S. Cl.
CPC ..... *E05D 15/0656* (2013.01); *E05D 15/0686* (2013.01); *E05Y 2201/11* (2013.01); *E05Y 2900/142* (2013.01)

(58) Field of Classification Search
CPC ..... E05D 15/0656; E05D 15/0686; E05Y 2900/142; E05Y 2201/11; Y10T 16/376
See application file for complete search history.

(56) References Cited

U.S. PATENT DOCUMENTS 2,078,811 A * 4/1937 Rouse ..... E05D 15/0686 238/6
5,203,116 A * 4/1993 Chen ..... E05D 15/0621 16/95 R (Continued)

FOREIGN PATENT DOCUMENTS

DE 2844877 A1 4/1980
DE 102008039415 A1 2/2010

(Continued)

OTHER PUBLICATIONS

Extended European Search Report dated Jul. 22, 2019 in related/corresponding EP Application No. 19166325.1 (references from EESR not cited herewith have previously been made of record).

(Continued)

*Primary Examiner* — Justin B Rephann
(74) *Attorney, Agent, or Firm* — Patent Portfolio Builders PLLC

(57) ABSTRACT

A sliding wall arrangement includes at least one wing and a running rail that can be sunk in a building floor and has at least one guide channel in which the at least one wing is displaceably mounted at the lower edge. At least one covering element is provided, which serves for covering the at least one guide channel if the guide channel is freed from the at least one displaceable wing. The at least one covering element has a raised state in which it covers the guide channel freed from the wing, and a lowered state in which it is lowered into the at least one guide channel, with the result that the at least one wing can be displaced across the at least one covering element.

18 Claims, 6 Drawing Sheets

(56) References Cited

U.S. PATENT DOCUMENTS

| | | | | |
|---|---|---|---|---|
| 8,375,516 | B2 * | 2/2013 | Baines | E05D 15/0665 16/91 |
| 8,984,810 | B2 | 3/2015 | Bortoluzzi et al. | |
| 10,494,847 | B1 * | 12/2019 | Phillip | E05D 15/0686 |
| 2008/0202033 | A1 * | 8/2008 | Hancock | E06B 3/303 49/472 |
| 2010/0064590 | A1 * | 3/2010 | Jones | E05D 15/0656 49/469 |
| 2010/0218430 | A1 * | 9/2010 | Baines | E05D 15/0665 49/425 |
| 2013/0042535 | A1 * | 2/2013 | Fleeting | E06B 7/26 49/476.1 |
| 2013/0212948 | A1 * | 8/2013 | Nixon | E05F 3/225 49/349 |
| 2015/0033633 | A1 * | 2/2015 | Tarrega Lloret | E06B 7/16 49/406 |
| 2016/0265259 | A1 * | 9/2016 | Angebault | E05D 15/0686 |

FOREIGN PATENT DOCUMENTS

| | | | |
|---|---|---|---|
| EP | 2093364 | A1 | 8/2009 |
| GB | 13915 | | 5/1910 |
| GB | 457874 | A | 12/1936 |
| JP | 2001311362 | A | 11/2001 |
| JP | 2005133298 | A | 5/2005 |
| RU | 2100269 | C1 | 12/1997 |
| RU | 2514231 | C2 | 4/2014 |
| RU | 2594855 | C2 | 8/2016 |
| WO | 2012156468 | A1 | 11/2012 |
| WO | 2015150991 | A1 | 10/2015 |

OTHER PUBLICATIONS

International Search Report dated Sep. 15, 2017 in related/corresponding International Application No. PCT/EP2017/065512.

Written Opinion dated Sep. 15, 2017 in related/corresponding International Application No. PCT/EP2017/065512.

Search Report dated May 27, 2020 in related/corresponding RU Application No. 2018146626 (references from Search Report not cited herewith have previously been made of record).

* cited by examiner

SLIDING WALL ARRANGEMENT WITH A COVERING ELEMENT

FIELD OF INVENTION

Exemplary embodiments of the present invention relate to a sliding wall arrangement having at least one wing, which is mounted so it is displaceable in a guide channel of a running rail which can be sunk into a building floor.

BACKGROUND OF THE INVENTION

Sliding wall arrangements having at least one wing, which is mounted in a running rail that can be sunk into the building floor and is displaceable along this running rail, are generally known. They enable a broad perspective and can be produced without sills and with a comparatively small frame component. Because of the sinking of the lower running rail into the floor, a profile-free transition of the wing to the floor as possible. A maximum clear opening is thus possible. The wings are usually glazed multiple times and generally have a peripheral profile.

In such sliding walls, good thermal insulation and sound insulation are essential. The running rails of such sliding walls therefore generally consist of at least two profiles, for example, aluminum profiles, which are fixedly connected to one another via thermally-insulated connecting elements. The separation by such connecting elements, which generally consist of plastic, enables effective thermal separation of the two profiles, in each of which one wing is displaceably guided. Moreover, effective drainage is essential in the case of sunken running rails.

Increasingly, such sliding walls are produced with thicker wings, which are to enable even better thermal and sound insulation. The guide channels accordingly have to be produced wider, so that wider sliding walls can be sunk therein. However, wide guide channels are rather undesirable, in particular from an aesthetic aspect. In principle, it is also possible that such wide guide channels are unfavorable when using shoes having narrow heels. Depending on the country, there are additionally standards for handicapped-accessible construction, which restrict the dimensions of sills and floor openings.

Therefore, guide channels have become known in the prior art, for example, from JP 2001311362 and DE 28 44 877, which have a flap, which is folded downward when the door is opened and which covers the upper opening of the corresponding guide channel. To be able to close the door again, the flap has to be pivoted again, which self-evidently can be complex and undesirable.

JP 2005133298 discloses a sliding wall, in which the guide channel is covered by steel strips, which are attached on both sides of the sliding wall. Upon opening of the door, the steel strip located in the opening direction is bent downward by 180° at the outer end of the guide channel and returned into a part of the guide rail arranged below the guide channel. Further such solutions are disclosed in US 2015/0033633 A1 and WO 2015/150991 A1.

WO 2012/156468 A1 discloses a sliding wall arrangement, in which a cover strip attached to the displaceable wing is pushed across the guide channel when it is uncovered upon displacement of the wing. In this case, the cover strip extends in a channel arranged outside the lateral door frame when the wing is closed.

The options in the case of such systems having trailing cover strip are restricted. Thus, such a solution cannot be used, for example, in sliding wall arrangements in which more than one displaceable wing is provided per guide channel. In sliding wall arrangements in which the guide channel is formed particularly long in relation to the displaceable wing, it can be difficult to provide sufficient storage space for the cover strip. Moreover, the displacement and deflection of the long cover strip can have the result, in particular upon penetration of dirt particles, that the smooth running of the displaceable wing is impaired as a result of friction forces.

SUMMARY OF THE INVENTION

Exemplary embodiments of the invention are directed to providing a sliding wall arrangement of the type mentioned which avoids the mentioned disadvantages. The sliding wall is therefore also to be implementable having very wide guide channels, for example, having a width of 50 mm or more, without aesthetic or other problems arising here.

The present invention thus provides a sliding wall arrangement, having

- at least one wing having a lower edge,
- a running rail, which can be sunk into a building floor and has at least one guide channel, in which the at least one wing is displaceably mounted at the lower edge, and
- at least one cover element, which is used to cover the at least one guide channel when the guide channel is uncovered by the at least one displaceable wing.

The at least one cover element has a raised state, in which the cover element covers the guide channel uncovered by the wing, and a lowered state, in which the at least one cover element is lowered into the at least one guide channel, so that the at least one wing is displaceable across the at least one cover element.

The at least one cover element can thus be lowered into the guide channel to enable a displacement of the wing or wings across the cover element. The guide channel, in which the at least one displaceable wing is mounted, is therefore used for storing the cover element in the lowered state.

The raised or lowered state typically relates to the entire cover element, which is raised or lowered, i.e., moved upward or downward, respectively, along its entire longitudinal extension and as a whole. The raising and lowering movement thus, in particular, has a component perpendicular to the longitudinal direction of the cover element. It is possible that the sunken cover element is moved by a certain distance along its longitudinal direction at the same time. However, the movement travel of the sunken cover element along its longitudinal direction is preferably at most five times as great as the movement of the sunken cover element perpendicular to his longitudinal direction, even more preferably at most twice as great as the movement perpendicular to the longitudinal direction, and most preferably approximately in the order of magnitude of the movement perpendicular to the longitudinal direction. The longitudinal direction or the direction of the longitudinal extension of the cover element typically corresponds in this case to the longitudinal direction or direction of longitudinal extension of the running rail.

In comparison to the raised state, the position of the cover element in the lowered state preferably differs solely by way of a parallel displacement. Preferably, even the entire movement sequence of the cover element from the raised to the lowered state, and advantageously also the movement sequence from the lowered into the race state, solely represents a parallel displacement.

Preferably, the cover element as a whole has the same shape in the raised state as in the lowered state, i.e., it is neither bent, compressed, reduced in size, enlarged in size, or reshaped in another way. The cover element is advantageously formed in one piece as a whole.

The displaceable wing can be the wing, for example, of a sliding door or a sliding window, which is displaceable along the longitudinal extension of the running rail. The displaceable wing generally has at least one glass pane. The guide channel is advantageously covered by the wing in the region of the wing and by the at least one cover element in the regions outside the wing.

The sliding wall arrangement preferably has a closed position with respect to the at least one wing, in which the at least one wing closes a passage closable by the sliding wall arrangement. In this closed position, the at least one guide channel is advantageously covered by the at least one wing in the region of the at least one wing and by the at least one cover element in all regions outside the at least one wing.

The lowering of the cover element can be achieved in various ways. However, preferably at least one spring mechanism is arranged in the at least one guide channel, which applies a spring force oriented toward the raised state to the at least one cover element. The lowering is then preferably caused with the aid of the weight force of the wing acting on the cover element when the wing is displaced across the at least one cover element. The spring mechanism advantageously has one or more leg springs in this case.

A guide means is provided, which is arranged in the at least one guide channel and is used for mounting the at least one wing. The guide means can in particular be one or more running rollers. The running rollers are advantageously arranged in series and in the guide channel at regular intervals along the longitudinal extension thereof. The at least one wing then generally has at least one running surface on its lower side, which is moved across the running rollers during the displacement of the wing, so that they roll on the running surface. Of course, in an alternative embodiment, the running rollers can also be attached to the lower side of the at least one wing, and one or more running surfaces can be provided in the at least one guide channel, on which the running rollers can roll during the displacement of the wing. The running surface(s) arranged in the guide channel can also be considered to be guide means in such an alternative embodiment.

In the raised state, the cover element is arranged above the guide means and advantageously covers it on top. In the lowered state, the guide means preferably protrude upward beyond the cover element. The cover element is thus preferably lowered at least far enough into the guide channel in the lowered state that the uppermost point of the guide means protrudes upward above it. The at least one wing can thus be displaced across the at least one cover element and mounted by the guide means simultaneously.

The cover element advantageously has at least one opening, to enable the guide means to protrude through the cover element in the lowered state. The opening can be formed laterally open or can be completely laterally enclosed by the material of the cover element. The provision of at least one opening in the cover element enables a greater coverage of the guide channel in the raised state of the cover element.

A first and a second guide means are preferably arranged in the guide channel, which are both used for mounting the at least one wing and advantageously extend spaced apart and parallel to one another along the displacement direction of the wing. Both the first and also the second guide means can also be one or more running rollers in each case. Two parallel rows of running rollers arranged in succession, which extend in the longitudinal direction of the running rail, are advantageously provided, across which the at least one wing is displaceable such that the wing can roll with its lower side in series across the running rollers. Of course, the running rollers can also be attached on the lower side of the wing in such an embodiment, and one or more running surfaces for the running rollers can be provided in the guide channel.

In one particularly preferred embodiment, the at least one cover element is connected to the running rail in such a way that the at least one cover element is movable in a guided movement, in particular a parallel displacement, in relation to the running rail from the raised into the lowered state and from the lowered into the raised state. In this manner, it can be ensured that the cover element is always arranged parallel with the running rail, which is obviously accompanied by aesthetic and functional advantages.

A guided parallel displacement of the cover element in relation to the running rail can be achieved in manifold ways, for example, by means of a slotted guide. In one preferred embodiment, however, at least one support block is arranged so it is movable in the at least one guide channel. This at least one support block is preferably movably connected to the running rail and the cover element in such a way that the guided movement, in particular parallel displacement, of the cover element is predefined by the at least one support block. The at least one support block is advantageously also used to absorb weight forces acting on the at least one cover element in the raised state, and preferably also in the lowered state. In this manner, substantially higher weight forces can be absorbed by the sunken cover element.

The at least one support block advantageously has a rounded rolling surface, to enable uniform rolling of the support block when the at least one cover element is moved from the lowered into the raised state or from the raised into the lowered state, respectively. Moreover, the at least one support block preferably has a substantially planar contact surface. By means of the planar contact surface, the weight forces can be dissipated well and undesired further movement of the support block is prevented.

The at least one cover element is preferably formed as a profile rail which is essentially U-shaped in cross-section. Parts arranged in the guide channel can thus be protected well from external influences and in particular penetrating dirt particles.

To move the at least one cover element during the displacement of the wing in an essentially continuous uniform movement from the raised into the lowered state and from the lowered into the raised state, a wedge-shaped stop element is advantageously attached on the wing.

Optimum smooth running of the at least one wing can be achieved if rollers are attached on its lower edge, which roll on an upper side of the at least one cover element during the displacement of the wing and thus hold it in its lowered state.

Multiple cover elements are preferably provided, to advantageously completely cover a single guide channel in segments. The multiple cover elements are preferably arranged in succession in this case. To enable advantageously good, continuous coverage and interlocking of cover elements arranged in succession, the cover elements, or at least one of the cover elements, can have, in specific embodiments, a first end having a part protruding along a first displacement direction of the wing and a second end having an opening, which extends along a second displacement direction of the wing opposite to the first displacement direction and is formed open outward. The opening is preferably formed complementary to the protruding part.

BRIEF DESCRIPTION OF THE DRAWINGS

Preferred embodiments of the invention will be described hereafter on the basis of the drawings, which merely serve for explanation and are not to be interpreted as restrictive. In the figures of the drawings.

DESCRIPTION OF THE INVENTION

Figure 1:
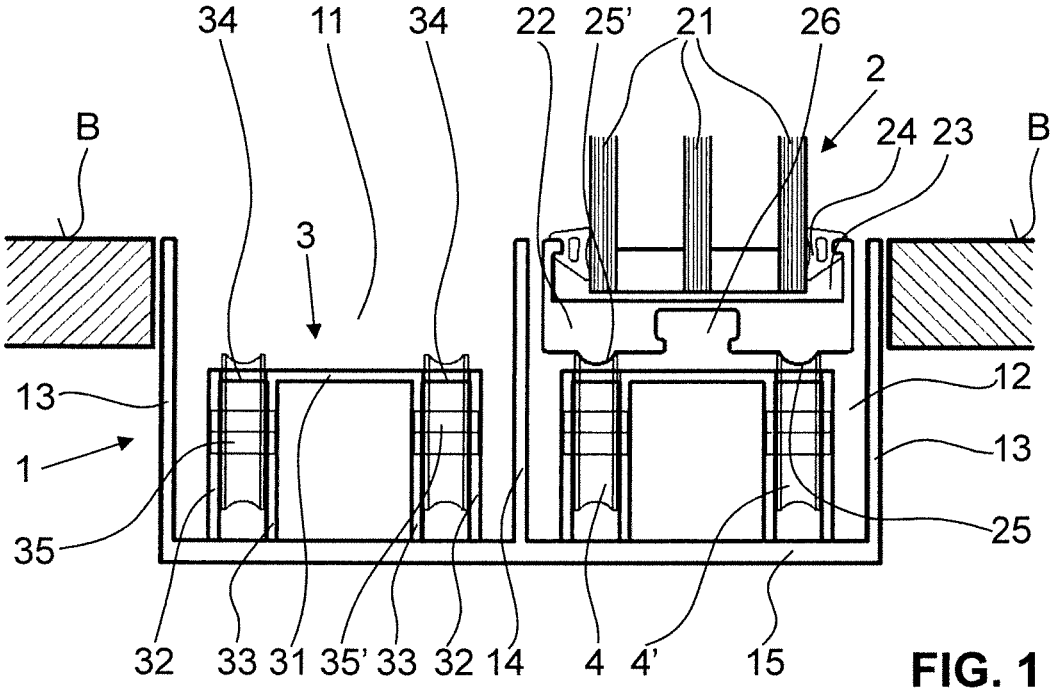
FIG. 1 shows a cross-sectional view through the lower region of a sliding wall arrangement known in the prior art, which is inserted into a depression provided in a building floor.
Figure 14:
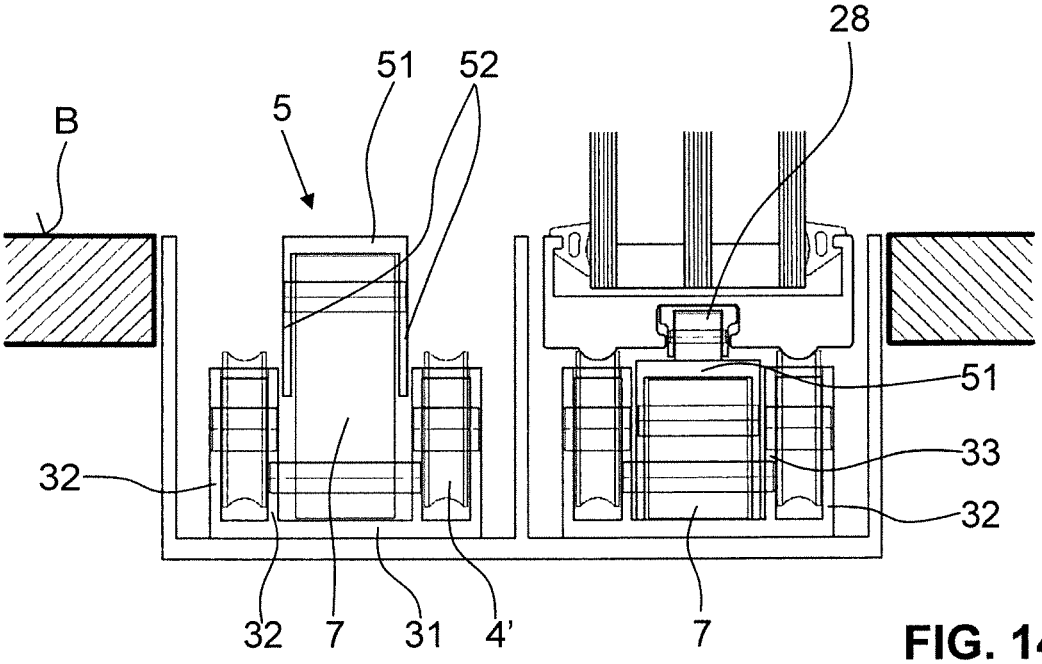
FIG. 14 shows a cross-sectional view through the lower region of a second embodiment of a sliding wall arrangement according to the invention, which is inserted into a depression provided in a building floor.
Figure 15:
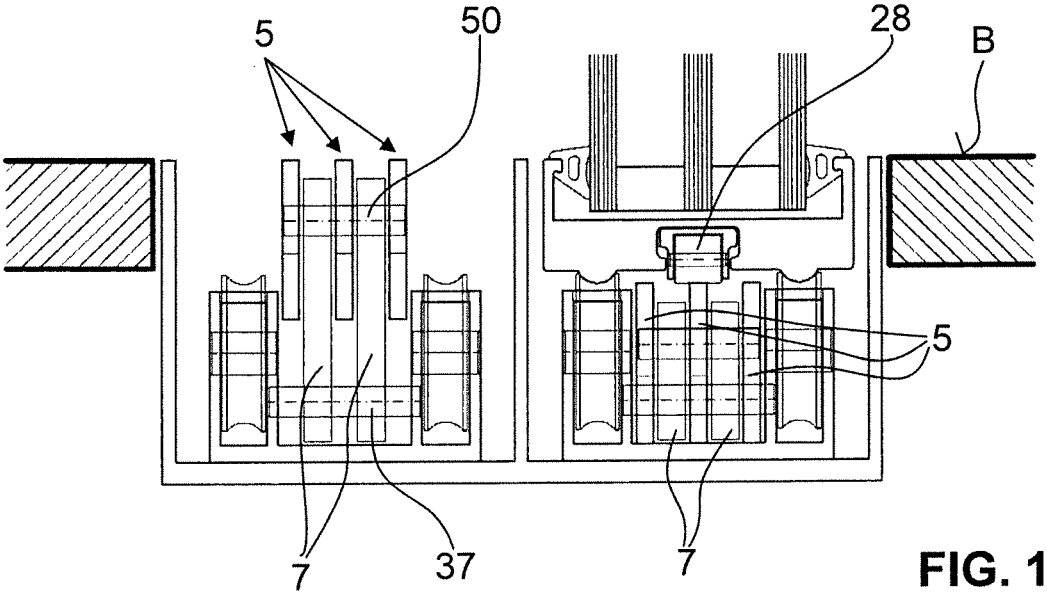
FIG. 15 shows a cross-sectional view through the lower region of a third embodiment of a sliding wall arrangement according to the invention, which is inserted into a depression provided in a building floor.

A sliding wall arrangement known in the prior art is shown in FIG. 1. FIGS. 2 to 13 show a first embodiment of a sliding wall arrangement according to the invention. Further embodiments of sliding wall arrangement according to the invention are shown in FIGS. 14 and 15. Similar or identically-acting elements of the various embodiments of sliding wall arrangements are provided with the same reference signs in each of FIGS. 1 to 15.

The sliding wall arrangement of the prior art illustrated in FIG. 1 has a running rail 1 having a first guide channel 11 and a second guide channel 12. The running rail 1 is formed by a profile rail, whose cross-section is identical over the entire longitudinal extension of the running rail 1. The two guide channels 11 and 12 extending in parallel to one another are each delimited laterally outward by a lateral web 13 and separated from one another by a middle web 14. The two lateral webs 13 and the middle web 14 extend parallel to one another and perpendicularly upward from a main section 15. The main section 15 thus connects the side webs 13 and the middle web 14 to one another.

The running rail 1 is sunk into a building floor in such a way that the guide channels 11 and 12 are open on top and the upper end faces of the side webs 13 and the middle web 14 come to rest flush with the floor surface B.

The two guide channels 11 and 12 are each used for mounting one or multiple wings, which are displaceably guided along the longitudinal direction of the guide channels 11, 12. The wings 2 can be, in particular, wings of a sliding window or a sliding door. Because of the dimensioning of the guide channels 11, 12 and because of the sunken arrangement of the running rail 1 in the building floor, a part of a frame 22 extending along the lower side of the wing 2 can be completely accommodated by the respective guide channel 11 or 12. The lower part of the frame 22 is thus largely invisible to the observer and the width of the clear opening in the perspective through the glass panes 21 held in the frame 22 is maximized.

The lower part of the frame 22, which is arranged inside the guide channel 11 or 12, has an upper channel 23, which is open on top and which is used for accommodating and holding the glass panes 21. Seal elements 24 can be provided in the region between the frame 22 and the glass panes 21.

The lower side of the frame 22 forms two running surfaces 25 and 25' extending parallel to one another, which are each formed curved in the present case. A lower channel 26, which is open toward the bottom, can be provided between the two running surfaces 25 and 25'.

A base rail 3 having running rollers 4 or 4' attached thereon is attached in each case for guiding the wing 2 in the guide channels 11 and 12. The base rails 3 are formed as profile rails each having a substantially unchanging cross-section along the longitudinal extension of the base rail 3. They each have a main section 31, from which two outer webs 32 and two inner webs 33 extend downward in the perpendicular direction and parallel to one another. The outer webs 32 and the inner webs 33 each extend the same distance downward and end with their lower end faces at the upper side of the main section 15 of the running rail 1.

The running rollers 4 or 4' are attached at regular intervals along the longitudinal extension of the running rail 1 in two parallel rows so they are freely rotatable between the outer webs 32 and the inner webs 33. The first row of running rollers 4 forms a first guide means and the second row of running rollers 4' forms a second guide means for guiding the wing 2. The running rollers 4 or 4' are each attached on running roller axles 35 or 35', respectively, which each extend from an outer web 32 to an inner web 33. An empty space, which is unused, remains between the inner webs 33 of the base rail 3.

Openings 34, through which the running rollers 4, 4' protrude, to enable resting of the running surfaces 25, 25' on the running rollers 4, 4', are provided above each of the running roller axles 35, 35' in the main section 31 of the base rail 3.

The radial outer surfaces of the running rollers 4, 4' are formed complementary to the running surfaces 25 or 25', respectively, of the frame 22 because of their curvature, which is oriented radially inward. During the displacement of the wing 2, the running surfaces 25 and 25' of the frame 22 rest on the running rollers 4, 4', which roll on the running surfaces 25, 25' and thus ensure easy displaceability of the wing 2. Due to the interlocking of the running surfaces 25, 25' and the running rollers 4, 4' with their surfaces formed complementary because of the respective curvature, lateral guiding of the wing 2, i.e., perpendicular to the displacement direction, is achieved.

The base rails 3 can be fixedly connected to the running rail 1, in particular welded thereto in each case. The running rail 1 can also be formed in one piece with the base rails 3.

The sliding wall arrangement of the prior art shown in FIG. 1 has the significant disadvantage that the guide channels 11, 12 are uncovered outside the displaceable wing 2. Dirt can thus penetrate easily into the guide channels 11, 12. In addition, the guide channels thus form a tripping hazard and are unfavorable in particular for high-heeled shoes.

Figure 2:
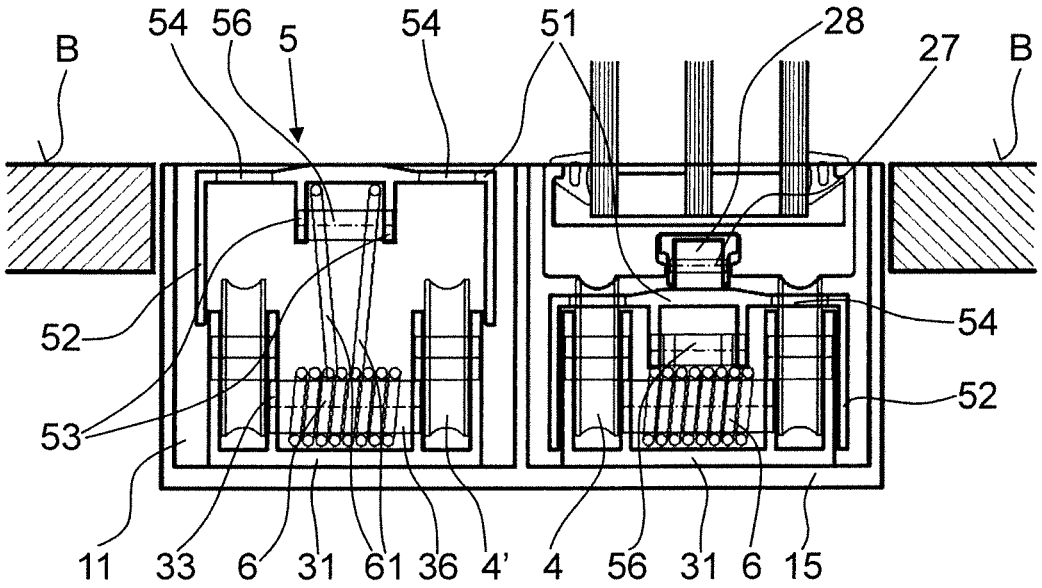
FIG. 2 shows a first cross-sectional view through the lower region of a first embodiment of a sliding wall arrangement according to the invention, which is inserted into a depression provided in a building floor.
Figure 3:
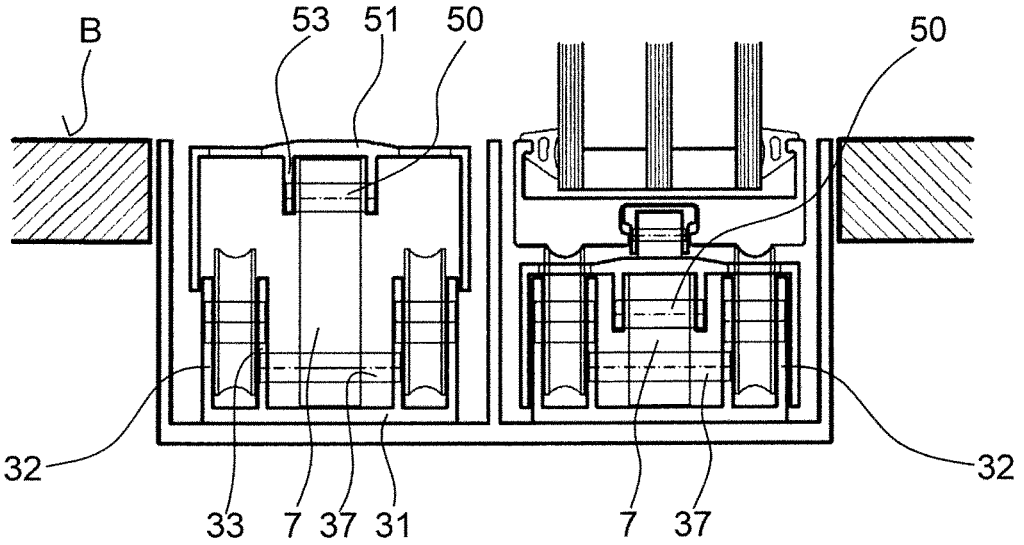
FIG. 3 shows a second cross-sectional view through the sliding wall arrangement of FIG. 2.
Figure 4:
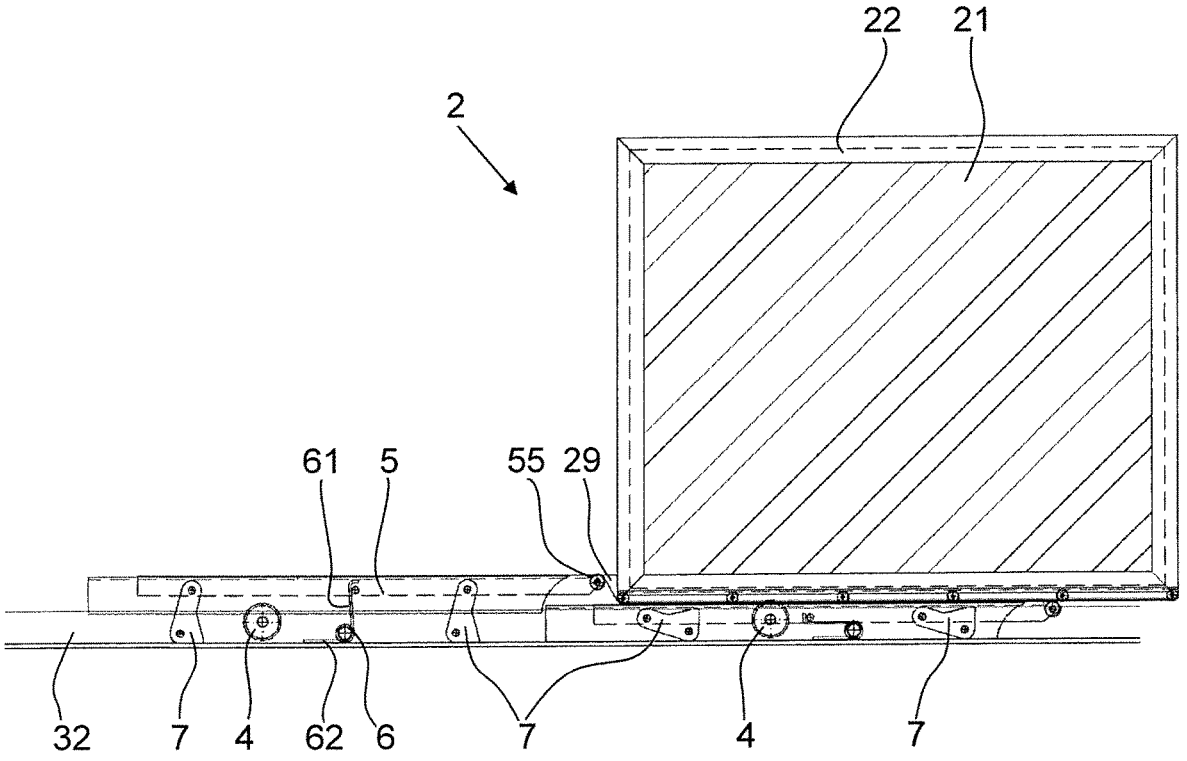
FIG. 4 shows a side view of the sliding wall arrangement of FIG. 2, without the running rail.

In the embodiment according to the invention shown in FIGS. 2 to 13, these disadvantages of the prior art are solved in that a cover element 5 is provided, which has a raised state and a lowered state. In the raised state, the cover element 5 covers the guide channel 11 or 12, which would otherwise be uncovered, as shown in FIG. 2 on the left side at the guide channel 11. To enable a displacement of the wing 2 across the cover element 5, it is moved into the lowered state, as shown in FIG. 2 on the right side at the guide channel 12. The guide channel 12 is then covered by the wing 2.

The running rail 1 is formed identically to that of the embodiment of the prior art of FIG. 1.

In contrast to the embodiment of the prior art shown in FIG. 1, however, the base rail 3, which is formed substantially identically, is arranged reversed in the running rail 1, so that the main section 31 rests directly on the main section 15 of the running rail 1 and the outer webs 32 and the inner webs 33 extend upward from the main section 31. In contrast to the base rail of FIG. 1, that of FIG. 2 does not have openings 34. The running rollers 4, 4' are arranged here in such a way that the free ends of the inner webs 33 and outer webs 32 protrude upward and thus enable resting of the running surfaces 25, 25' of the wing 2.

The cover element 5 is formed as a profile rail having a U-shaped cross-section, a main section 51 and two outer webs 52 extending parallel to one another and downward in the perpendicular direction. The upper side of the main section 51 comes to rest essentially flush with the floor surface B in the raised state of the cover element 5 and substantially covers the guide channel 11, 12 on top at the same time. The outer webs 52 bear with their inner surfaces facing toward one another on the outer surfaces of the outer webs 32 of the base rail 3, whereby laterally guided movement of the cover element 5 from the raised into the lowered state and vice versa is achieved. Moreover, the parts arranged below the cover element 5 are better protected from the penetration of dirt particles because of the outer webs 52.

Openings 54, which enable the running rollers 4, 4' to protrude through in the lowered state of the cover element 5, are provided in the main section 51 of the cover element 5. The cover element 5 is thus arranged above the running rollers 4, 4' in the raised state and below the running surfaces 25, 25' of the frame 22 in the lowered state.

Two inner webs 53 each extend downward perpendicularly from the main section 51 between the two outer webs 52 of the cover element 5. The inner webs 53 do not extend as far downward as the outer webs 52, however. The inner webs 53 are connected to one another at regular intervals along the longitudinal extension of the cover element 5 by transverse axles 50 and 56, the functions of which will be explained.

The upper side of the main section 51 of the cover element 5 has a middle part formed slightly elevated, which is used for the rolling of rollers 28, which are attached to the lower side of the frame 22, during the displacement of the wing 2. The rollers 28 are each attached so they are freely rotatable via a transverse axle 27 in the lower channel 26 of the frame 22. The wing 2 is otherwise formed identically to the embodiment of the prior art shown in FIG. 1.

The region of the base rail 3 between the two inner webs 33 is used in the present embodiment according to the invention for housing a spring mechanism having one or more leg springs 6. The spring mechanism applies a spring force to the cover element 5, which presses the cover element 5 in the direction of its raised state. The one or more leg springs 6 each have two upper legs 61, the end regions of which, as is apparent particularly well when considering FIGS. 2 and 5 together, each bear on the transverse axle 56 and are bent around it. Two lower legs 62 of the leg springs 6 each rest flatly on the upper side of the main section 31 of the base rail 3. A coiled part of the leg spring 6 is penetrated by a transverse axle 36, which is fastened with its respective ends on the inner webs 33 of the base rail 3.

The cover element 5 is thus moved into its raised state and held therein because of the spring force of the at least one leg spring 6. When the wing 2 is pushed across the cover element 5, the cover element 5 is pressed against the spring force into the lowered state and held therein by the weight force of the wing 2, which is transmitted via the rollers 28. The mutual friction between the wing 2 and the cover element 5 during the displacement of the wing 2 is minimized by the rolling of the rollers 28 on the main section 51 of the cover element 5.

In addition, support blocks 7 are arranged in the region between the inner webs 33 of the base rail 3, which are movably connected on one side to the cover element 5 and on the other side to the base rail 3. The connection to the cover element 5 is produced in each case via a transverse axle 50, which penetrates the support block 7, and around which the support block 7 is freely rotatable. The connection to the base rail 3 is produced in each case via a transverse axle 37, which extends between the two inner webs 33 of the base rail 3, and around which the support block 7 is also freely rotatable. The support block 7 therefore has two axle holes for the two transverse axles 50 and 37.

Figure 5:
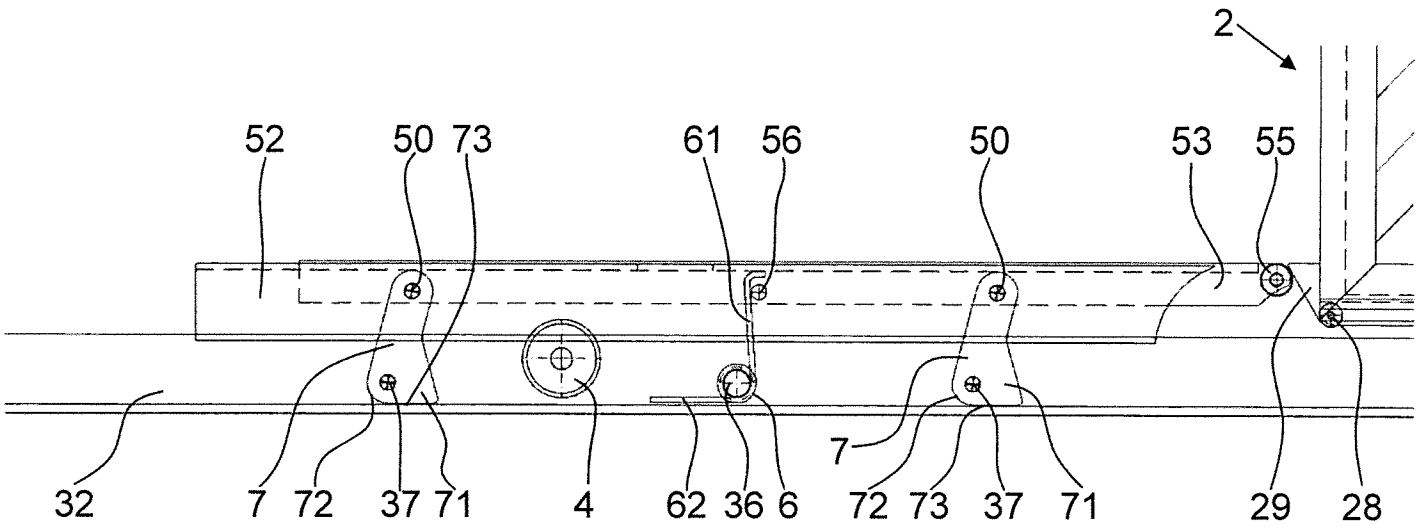
FIG. 5 shows a side view of the lower region of a part of the sliding wall arrangement of FIG. 2, with raised cover element and without the running rail.

The support blocks 7, which are all formed identically, have an elongated shape extending from the transverse axle 37 to the transverse axle 50 in the side view, as shown in FIG. 5, for example. A first side of the support block 7 facing toward the longitudinal direction of the running rail 1 in the raised state of the cover element 5 is essentially planar and merges into a rounded surface in the regions of each of the axle holes, wherein this surface extends around the corresponding axle hole in a semicircle in the region of the transverse axle 50. This surface extends around the corresponding axle hole over an angle range of approximately 75° in the region of the transverse axle 37 and thus forms a rolling surface 72 of the support block 7. This rolling surface 72 merges into a planar surface of an attachment 71 attached on the support block 7. This planar surface forms a contact surface 73 of the support block. The attachment 71 has a triangular shape in the side view, which is connected along one of its lateral lines in one piece to a planar second side of the support block 7. The second side of the support block 7 is formed between the two rounded surfaces of the support block 7 and faces in the opposite direction in comparison to the first side.

It can be seen well from FIG. 5 how the cover element 5 is borne in the raised state by two support blocks 7 and is held in this position by a leg spring 6 arranged therebetween. The support blocks 7 stand in this case with their contact surfaces 73 on the upper side of the main section 31 of the base rail 3. Because of the attachment 71, tipping over of the support blocks 7 is prevented, which could otherwise take place because of the spring force of the leg springs 6 possibly still present in this location of the cover element 5.

Figure 6:
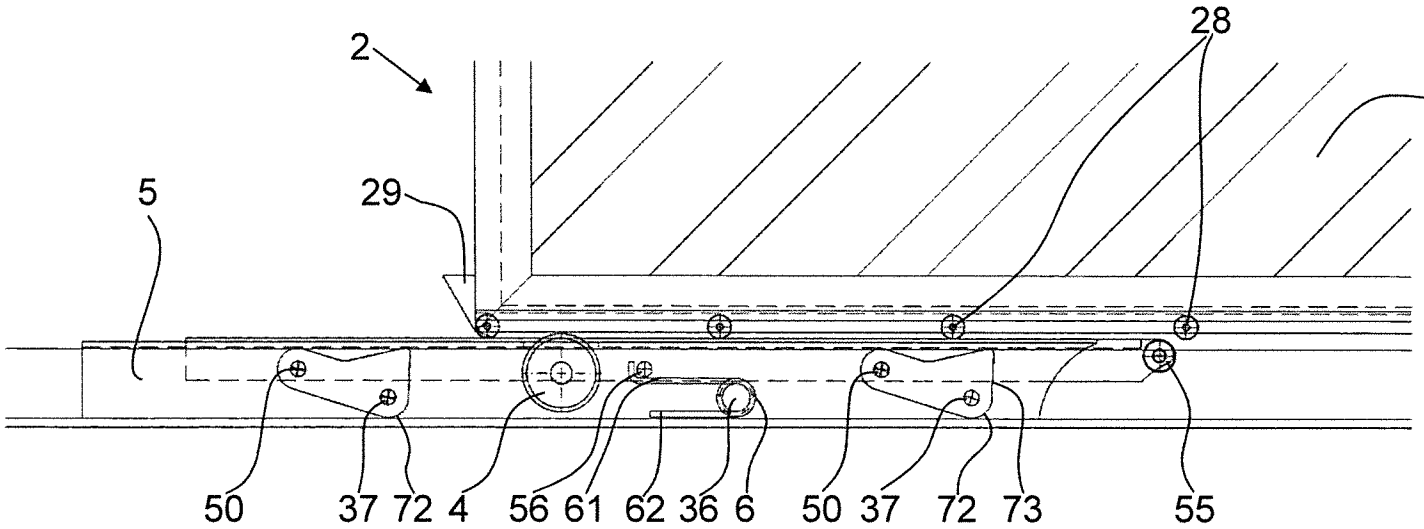
FIG. 6 shows the same view as in FIG. 5, but with wing displaced across the lowered cover element.

Upon displacement of the wing 2, the cover element 5 is pressed by means of stopping of the wing 2 on an end facing in the longitudinal direction of the running rail 1 against the spring force caused by the leg spring 6 horizontally along the longitudinal direction of the running rail 1 and downward into the guide channel 11, 12 (FIGS. 5 and 6). The upper leg 61 approaches the lower legs 62 of the leg spring 6 in this case. At the same time, the support blocks 7 tip over by approximately 90°, wherein the rolling surfaces 72 roll on the main section 31 of the base rail 3. The lowering of the cover element 5 is possible until the attachments 71 of the support blocks 7 stop on the lower side of the main section 51 of the cover element 5. The cover element 5 is held in the lowered state against the spring force by the weight force of the wing 2. The cover element 5 is then located below the lower edge of the wing 2 and completely inside the guide channel 11, 12 of the running rail 1 (see FIG. 6).

Because of the support blocks 7, the movement of the cover element 5 from the lowered into the raised state and vice versa occurs in a guided parallel displacement. It is thus ensured in particular that the cover element 5 is always arranged parallel to the running rail 1 and/or to the floor surface B. Furthermore, the support blocks 7 enable a high load of the cover element 5 in the raised state of the cover element 5.

Figure 8:
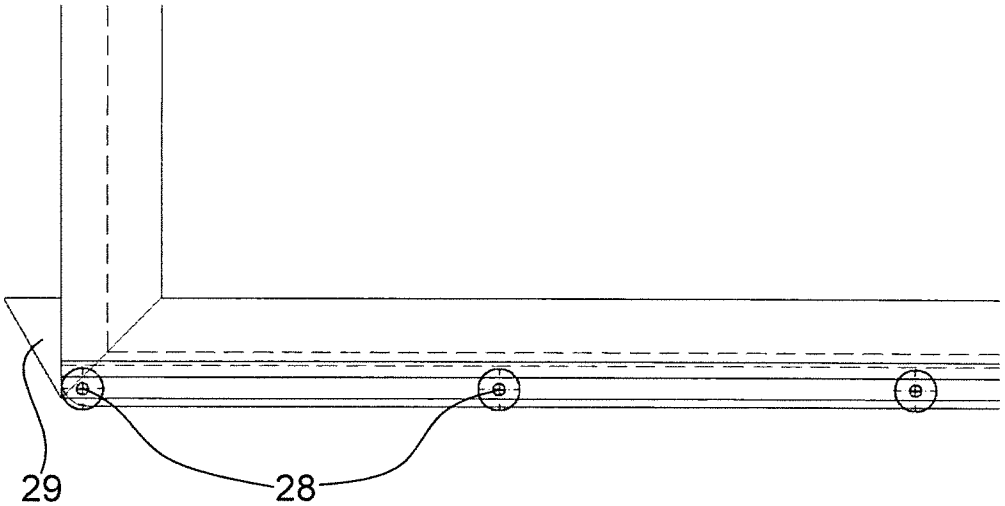
FIG. 8 shows a side view of the lower region of a part of the displaceable wing of the sliding wall arrangement of FIG. 2.
Figure 7:
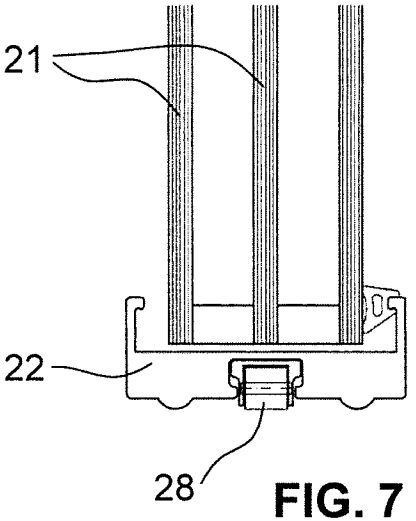
FIG. 7 shows a cross-sectional view through the lower region of the displaceable wing of the sliding wall arrangement of FIG. 2.
Figure 9:
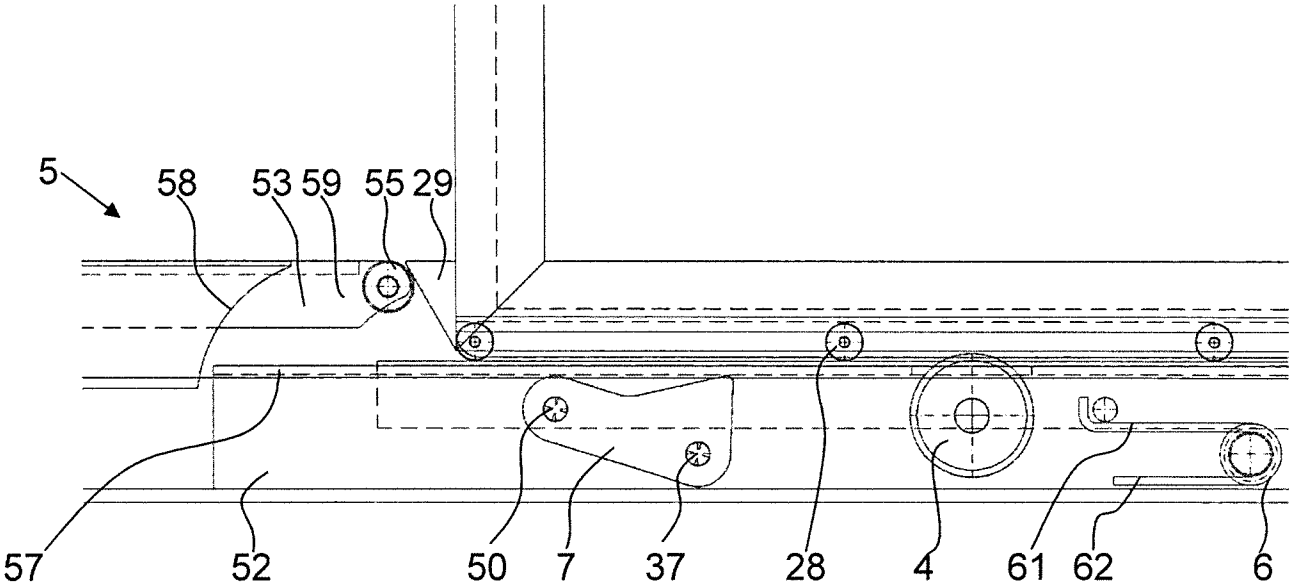
FIG. 9 shows a side view of the lower region of a part of the sliding wall arrangement of FIG. 2, during the displacement of the wing in the transition from a first to a second cover element, without running rail.
Figure 10:
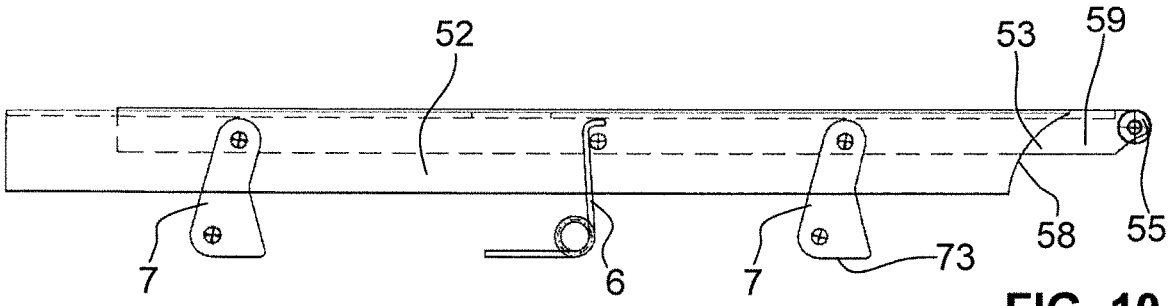
FIG. 10 shows a side view of a cover element and the spring mechanism and the support blocks of the sliding wall arrangement of FIG. 2, in the raised state of the cover element.
Figure 11:
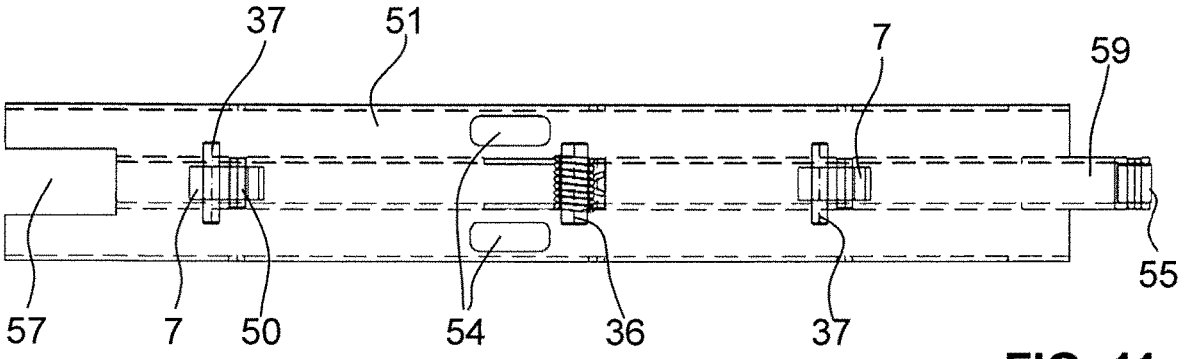
FIG. 11 shows a top view of the cover element shown in FIG. 10 including spring mechanism and support blocks.
Figure 12:
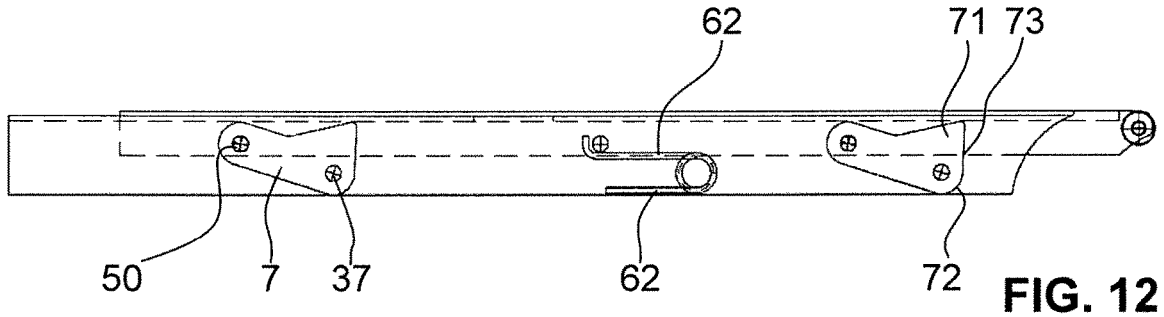
FIG. 12 shows a side view of a cover element and the spring mechanism and the support blocks of the sliding wall arrangement of FIG. 2, in the lowered state of the cover element.
Figure 13:
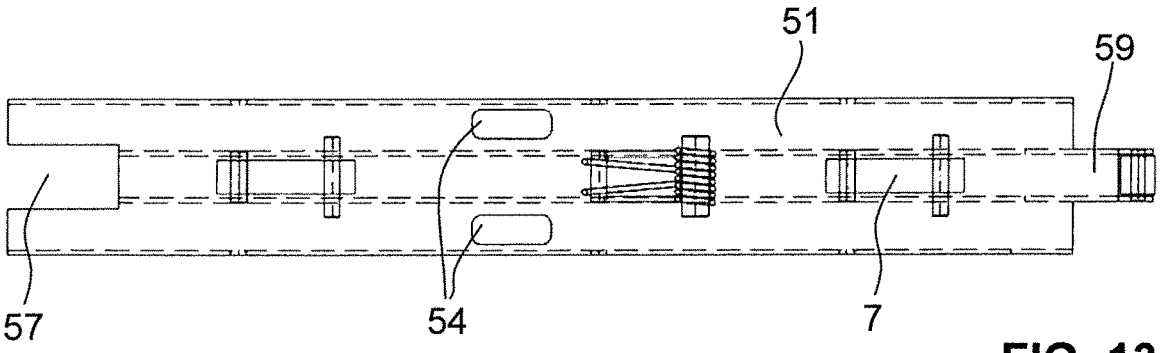
FIG. 13 shows a top view of the cover element shown in FIG. 12 including spring mechanism and support blocks.

To achieve lowering of the cover element 5 in a continuous uniform movement during the displacement of the wing 2, a wedge 29 can be attached on the lower region of one or both of the end faces of the wing 2 facing in the displacement direction (see, for example, FIGS. 8 and 9). Moreover, a freely rotatable roller 55 can be attached at the end of the cover element 5, which rolls on a lower inclined surface of the wedge 29 during the displacement of the wing 2. Because of the wedge 29, the force exerted by the wing 2 on the cover element 5 has both a horizontal and also a vertical, downwardly oriented force component.

If the wing 2 is located only partially above the cover element 5, a certain opening of the running rail 1 remains outside the wing 2. The cover element 5 is in the lowered state, but the wing 2 is then not located in all regions above the cover element 5. However, the cover element 5 also substantially reduces in size the exposed opening of the running rail 1 in the lowered state and also covers the parts arranged in the running rail, such as the leg springs 6, the support blocks 7, and the base rail 3 in particular, which has an aesthetically appealing effect for the observer. The cover element 5 thus still causes a certain coverage of the guide channels 11, 12 in the lowered state. A high weight load of the cover element 5 is also possible in the lowered state due to the stop of the attachments 71 of the support blocks 7 on the lower side of the cover element 5, for example, as shown in FIG. 6.

As is apparent from FIG. 9, multiple cover elements 5 arranged in succession can be provided in a guide channel 11, 12, which are pressed downward in the lowered state in series during the displacement of the wing 2. The more cover elements 5 are provided, the shorter the regions are between the wing 2 and the respective next cover element 5 located in the raised state. It is also possible without problems for multiple displaceable wings 2 to be mounted in a single guide channel 11, 12.

During the transition from the raised into the lowered state, the cover element 5 is moved over a certain distance along the longitudinal extension of the running rail 1 as a result of the tilting movement of the support blocks 7. To take this circumstance into consideration, in particular in the case of multiple cover elements 5 arranged in succession, the outer webs 52 can each have a rounding 58 in the end regions of the cover elements 5, as is apparent in FIGS. 10 and 12.

To enable a continuous coverage and interlocking of cover elements 5 arranged in succession, they each advantageously have a protruding middle part 59 in a first end region, on which the roller 55 is attached, and an opening 57 formed open in the longitudinal direction of the cover element 5 in a second, opposing end region, which is formed complementary to the protruding middle part 59 of the cover element 5 adjoining thereon. See FIGS. 11 and 13 in this regard.

A second embodiment of a sliding wall arrangement according to the invention is shown in FIG. 14. In contrast to the first embodiment shown in FIGS. 2 to 13, the cover element 5 does not extend beyond the outer webs 32 of the base rail 3 here, but rather is located completely within the inner webs 33 of the base rail 3. In this embodiment, which is somewhat structurally simpler than the first embodiment, however, a certain coverage of the running rail 1 and reduction in size of the exposed guide channel 11, 12 is also achieved. The spring mechanism housed in the base rail 3 and also the support blocks are also covered well by the cover element 5 here.

A third embodiment of a sliding wall arrangement according to the invention is shown in FIG. 15. In this embodiment, multiple cover elements 5 formed and arranged as lamellae are provided, which are arranged upright in the guide channel 11 or 12, respectively. Multiple, specifically two, thin support blocks 7, instead of only one thick one, are arranged parallel to one another between the cover elements 5, which support blocks are each penetrated by a common transverse axle 50 and a common transverse axle 37. The transverse axles 50 moreover also hold together the cover elements 5 arranged parallel to one another. A coverage of the running rail 1 and reduction in size of the exposed guide channel 11, 12 is also achieved here by the cover elements 5.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE SIGNS

B floor surface
1 running rail
11 first guide channel
12 second guide channel
13 side web
14 middle web
15 main section
2 wing
21 glass pane
22 frame
23 upper channel
24 seal element
25, 25' running surface
26 lower channel
27 transverse axle
28 roller
29 wedge
3 base rail
31 main section
32 outer web
33 inner web
34 opening
35, 35' running roller axle
36 transverse axle
37 transverse axle
4, 4' running roller
5 cover element
50 transverse axle
51 main section
52 outer web
53 inner web
54 opening
55 stop roller
56 transverse axle
57 opening
58 rounding
59 protruding middle part
6 leg spring
61 upper leg
62 lower leg
7 support block
71 attachment
72 rolling surface
73 contact surface

The invention claimed is:

1. A sliding wall arrangement, comprising:
at least one wing having a lower edge;
a running rail sunk into a building floor and having at least one guide channel, in which the at least one wing is displaceably mounted at the lower edge; and
a guide means arranged in the at least one guide channel, wherein the guide means support the at least one wing and guide the at least one wing along the running rail; and
at least one cover element configured to cover the at least one guide channel when the at least one guide channel is uncovered by the at least one displaceable wing,
wherein the at least one cover element has
a raised state, in which the at least one cover element covers the at least one guide channel uncovered by the at least one wing, and
a lowered state, in which the at least one cover element shifts along the running rail in a same direction as the at least one wing and the at least one cover element is lowered into the at least one guide channel so that the at least one wing is displaceable across the at least one cover element.

2. The sliding wall arrangement of claim 1, wherein the guide means protrude upward above the at least one cover element in the lowered state.

3. The sliding wall arrangement of claim 1, wherein a position of the at least one cover element in the lowered state differs from a position in the raised state solely by way of a parallel displacement.

4. The sliding wall arrangement of claim 1, further comprising:
a spring mechanism arranged in the at least one guide channel, wherein the spring mechanism applies a spring force oriented toward the raised state to the at least one cover element, and wherein the spring mechanism has one or more leg springs.

5. The sliding wall arrangement of claim 1, wherein the cover element has at least one opening configured to enable the guide means to protrude through the at least one cover element in the lowered state.

6. The sliding wall arrangement of claim 5, further comprising:
a second guide means arranged in the at least one guide channel, wherein the second guide means extends spaced apart and parallel to the guide means along a displacement direction of the wing.

7. The sliding wall arrangement of claim 6, wherein the guide means or the second guide means is one or more running rollers.

8. The sliding wall arrangement of claim 1, wherein the at least one cover element is connected to the running rail such that the at least one cover element is movable in a guided parallel displacement in relation to the running rail from the raised state into the lowered state and from the lowered into the raised state.

9. The sliding wall arrangement of claim 1, further comprising:
at least one support block, which is configured to absorb weight forces acting on the at least one cover element in the raised state, is movably arranged in the at least one guide channel.

10. The sliding wall arrangement of claim 9, wherein the at least one support block has a rounded rolling surface providing uniform rolling of the support block, and the at least one support block has an essentially planar contact surface.

11. The sliding wall arrangement of claim 1, wherein the at least one cover element is a profile rail that is at least essentially U-shaped in cross-section.

12. The sliding wall arrangement of claim 1, further comprising:
a wedge-shaped stop element attached to the at least one wing, wherein the wedge-shaped stop element is configured to move the at least one cover element during displacement of the wing in an essentially continuous uniform movement from the raised state into the lowered state and from the lowered into the raised state.

13. The sliding wall arrangement of claim 1, further comprising:

rollers attached to the lower edge of the at least one wing, wherein the rollers are arranged to roll on an upper side of the at least one cover element during displacement of the at least one wing and hold the at least one cover element in the lowered state.

14. The sliding wall arrangement of claim 1, wherein the at least one cover element comprises multiple cover elements arranged in succession to cover the at least one guide channel when at least one the guide channel is uncovered by the at least one displaceable wing.

15. The sliding wall arrangement of claim 14, wherein at least one of the multiple cover elements has a first end having a part protruding along a first displacement direction of the at least one wing and a second end having an opening extending along a second displacement direction of the at least one wing opposite to the first direction and is formed open outward.

16. The sliding wall arrangement of claim 1, wherein the at least one cover element, in the raised state, is arranged above the guide means.

17. A sliding wall arrangement, comprising:

a wing having a lower edge;

a running rail sunk into a building floor and having a guide channel, in which the wing is displaceably mounted at the lower edge;

running rollers arranged in the guide channel, wherein the running rollers support the wing and guide the wing along the running rail; and a cover configured to cover the guide channel when the guide channel is uncovered by the wing, wherein the cover has a raised state, in which the cover covers the guide channel uncovered by the wing, and a lowered state, in which the cover shifts along the running rail in a same direction as the wing and the cover is lowered into the guide channel so that the wing is displaceable across the cover, and wherein a portion of the running rollers protrude above the cover in the lowered state.

18. The sliding wall arrangement of claim 17, wherein the cover, in the raised state, is arranged above the running rollers.

* * * * *